US005632187A

United States Patent [19]

Speich

[11] Patent Number: 5,632,187

[45] Date of Patent: May 27, 1997

[54] PROCESS AND DEVICE FOR CUTTING A WEB OF TEXTILE FABRIC

[75] Inventor: Francisco Speich, Oberfrick, Switzerland

[73] Assignee: Textilma AG, Oberfrick, Switzerland

[21] Appl. No.: 643,847

[22] Filed: May 7, 1996

Related U.S. Application Data

[63] Continuation of Ser. No. 30,178, Jan. 28, 1994, abandoned.

[30] Foreign Application Priority Data

Jul. 18, 1991 [CH] Switzerland ..... 2142/91

[51] Int. Cl.[6] ..... B26D 7/06; D06H 7/04

[52] U.S. Cl. ..... 83/16; 83/171; 83/368; 83/651.1; 83/858; 83/938

[58] Field of Search ..... 83/171, 177, 16, 83/53, 858, 651.1, 370, 371, 368, 175, 176, 441, 936, 938; 139/291 C

[56] References Cited

U.S. PATENT DOCUMENTS

| | | | |
|---|---|---|---|
| 2,035,138 | 3/1936 | Maxfield . | |
| 2,609,009 | 9/1952 | Haefliger | 83/368 |
| 2,673,577 | 3/1954 | Mills . | |
| 2,960,748 | 11/1960 | Card | 139/291 C |
| 4,006,656 | 2/1977 | Shinomiya | 83/177 |
| 4,015,917 | 4/1977 | Ericson | 83/177 |
| 4,611,517 | 9/1986 | Schmale | 83/368 |
| 4,799,415 | 1/1989 | Gerdes | 83/177 |
| 4,850,085 | 7/1989 | Murasaki | 139/291 C |
| 4,920,841 | 5/1990 | Johnson | 83/53 |

FOREIGN PATENT DOCUMENTS

| | | |
|---|---|---|
| 67 23 10 | 3/1966 | Belgium . |
| 0 427 933 A1 | 5/1991 | European Pat. Off. . |
| 2077008 | 10/1971 | France . |
| 2 576 612 | 8/1986 | France . |
| 38 15 395 A1 | 3/1989 | Germany . |
| 392 415 | 9/1965 | Switzerland . |
| 1 335 477 | 10/1973 | United Kingdom . |

*Primary Examiner*—Kenneth E. Peterson
*Assistant Examiner*—Charles Goodman
*Attorney, Agent, or Firm*—Friedrich Kueffner

[57] ABSTRACT

The fabric run (4) has a hollow marker profile (12) arranged along a cutting line (10). A cutting device (16) is equipped with a sensing tongue (14) which engages in the hollow marker profile (12), and which guides a cutting tool (18) along the marker profile (12) and hence along the cutting line (10). Exact, dimensionally accurate cutting of a fabric run is thereby possible.

9 Claims, 3 Drawing Sheets

PROCESS AND DEVICE FOR CUTTING A WEB OF TEXTILE FABRIC

This is a continuation of application Ser. No. 08/030,178 filed Jan. 28, 1994, now abandoned, which is a 371 application of PCT/CH92/00130 filed Jun. 30, 1992.

TECHNICAL FIELD

The invention relates to a process for cutting a fabric run which has along at least one predetermined cutting line a marker profile defining the cutting line. The fabric run is being cut with a cutting device which is guided along the marker profile by means of a sensing device which senses the marker profile. The invention also relates to a cutting device for carrying out the process.

BACKGROUND ART

A process and a cutting device of the type mentioned above are known from several sources, e.g. from GB-PS 1 335 477. Along the cutting lines the fabric run described is furnished with a marker profile in the form of a thinning of the fabric. On a drive shaft the cutting device is equipped with adjustably arranged cutting disks, before which are arranged sensing pads that sense the marking profiles. The sensing pads are coupled via brackets with the cutting disks such that when the sensing pads are moved laterally, the attendant cutting disks move laterally along with the sensing pads, thereby providing alignment along the marker profile. A disadvantage of this arrangement is that at the cutting lines the already thin fabric can only have a slight change in shape in the form of a thickness reduction so that the danger always exists of the sensing pad moving to the side away from the marker profile, causing the cut to misalign with the marker profile and hence with the cutting line. Misalignment of the sensing pad and hence of the cutting disk is further augmented in that a relatively strong force is required to move the cutting disk laterally, whereas the lateral forces required to change the position of the sensing pad are slight. With this device precision cutting is difficult to achieve.

CH-PS 392 415 describes a device for lengthwise cutting of fabrics of the type mentioned above, lateral misalignment of the cutting tool being prevented in that twisted threads are woven in on both sides of the cutting lines, between which the weft threads are freely located. The cutting device is equipped with a sensing gearwheel before the cutting, the tapered teeth of which mesh with the twisted threads in the floating weft threads. The sensing gearwheel can be moved along a stationary axis, which serves as a support, and is connected with a blade holder of the cutting device. When the cutting tool misaligns with the cutting line the sensing gearwheel, which meshes with twisted threads, is moved laterally, and along with it the cutting tool. Disadvantageous here is the fact that between the twisted threads the fabric can have almost only floating weft threads to enable the meshing of the sensing gearwheel. The cutting device and the type of guiding of the cutting device are therefore only conditionally functional, and are unsuitable in particular for fabric runs that are cut thermally because with the thermal cutting adequate solidification of the floating weft threads is not possible. In addition, the fabric requires relatively sturdytwisted threads to guide the sensing gearwheel, thereby adversely affecting the fabric makeup. The process and the cutting device are not usable for a full fabric because they would damage the fabric.

DISCLOSURE OF THE INVENTION

The objective of the invention is to devise a process and a cutting device of the type mentioned above such that the aforementioned disadvantages are avoided.

In accordance with the present invention, the fabric run is manufactured with a hollow fabric marker profile in which a sensing tongue of the sensing device is guided. The cutting device for carrying out the process includes at least one cutting head adjustably arranged on a bracket which is aligned perpendicular to the fabric run. A sensing device with a mechanical sensing element is connected to the cutting head for guiding a cutting tool along a marker profile of the fabric run marking a cutting line. The sensing element is constructed as a sensing tongue arranged in front of the cutting tool for engaging in the marker profile which has the form of a hollow fabric marker profile.

By means of the process and the cutting device according to the present invention accurately controlled cutting of a fabric run along cutting lines can be achieved. The means employed to this effect are extremely simple, and damage to the fabric run is avoided. The process and the cutting device are also suitable in particular for fabric runs which consist of thermoplastic threads and which are cut by means of a hot cutting wire, and which during the cutting are bonded and fixed by welding. Lateral misalignments of the sensing device on a change in the course of the cutting line, and hence of the marker profile as well, is excluded because in the hollow fabric marker profile the sensing tongue is firmly guided. In this process the sensing tongue also generates the lateral forces required to position the cutting head, thereby providing optimum guiding and optimum cutting of the fabric run.

It is as a general rule possible for the sensing device to afford lateral adjustment of the cutting head of the cutting device perpendicular to the fabric run. Particularly simple however is a process in which a cutting head of the cutting device is pivoted perpendicularly to the fabric run by means of the sensing device, whereby lower forces are required to control the cutting tool.

The cutting process can take place independently in time and place of the production of the fabric run and the simultaneous affixing of the hollow marker profile. Especially advantageous is, however, an embodiment according to which the fabric run is cut simultaneously with the fabric run manufacturing process. In this process the fabric run will be knitted or preferably woven. The process is suited especially for fabric runs of thermoplastic material which can be cut by means of a heated cutting wire. The process is particularly suited for cutting a fabric run into narrow fabrics, preferably patterned label ribbons.

Various embodiments of the cutting device are possible. Hence, for example, the cutting head can be pivotally connected with the support, whereby relatively low lateral forces are required to guide the cutting tool along a cutting line. In accordance with another embodiment, the cutting head is arranged so as to be movable along the bracket. This enables greater lateral movement of the cutting head along the support.

In accordance with another feature, the cutting tool is a heatable cutting wire. This embodiment is particularly simple and effective because with this version in particular thermoplastic fabric runs can be cut, and the cut edges can be fixed.

As mentioned above, the cutting device can be employed independent of the manufacture of the fabric run in both space and time. Particularly preferred, however, is the use of the cutting device on a loom or knitting machine, wherein the cutting device preferably serves for cutting the fabric run into individual narrow fabrics. In this context it is particularly expedient for a thermofixing device to be arranged before the cutting device.

BRIEF DESCRIPTION OF THE DRAWINGS

Examples of embodiments of the subject of the invention are described below in detail on the basis of schematic drawings. Shown are.

MODE FOR CARRYING OUT THE INVENTION

Figure 1:
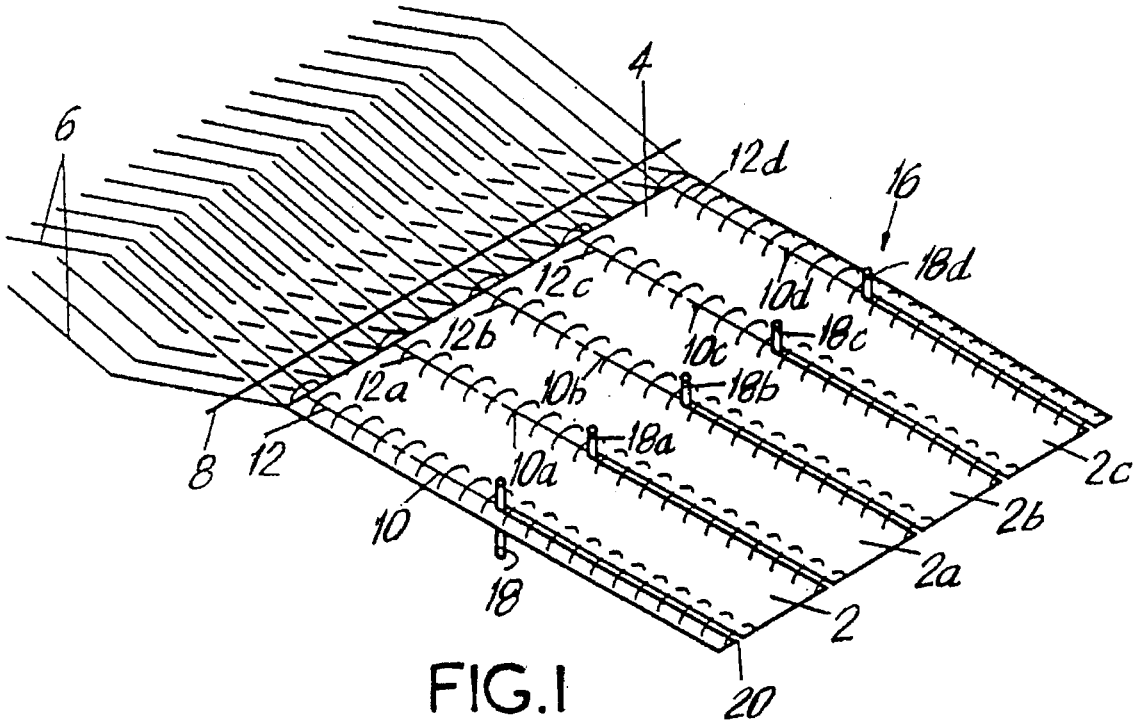
FIG. 1 a diagram depicting the manufacture of narrow fabrics from a broad, woven fabric run, in perspective view.

FIG. 1 shows schematically the production of ribbons 2, 2*a*, 2*b*, 2*c* by the cutting of a wide fabric run 4. This example relates to a woven fabric run consisting of synthetic, thermoplastic threads, the construction of which is shown in detail in FIGS. 2 to 4. The fabric run 4 consists of warp threads 6 and woven-in weft threads 8, the product being designed such that hollow fabric marker profiles 12, 12*a*, 12*b*, 12*c*, 12*d* are formed along cutting lines 10, 10*a*, 10*b*, 10*c*, 10*d* and serve to guide a sensing tongue 14 of the cutting tools 18, 18*a*, 18*b*, 18*c*, 18*d* of a cutting device 16. The cutting tools consist e.g. of heated cutting wires that cut the fabric run 4 along the cutting lines 10, 10*a*, 10*b*, 10*c*, 10*d*, such that the individual ribbons 2, 2*a*, 2*b*, 2*c*, 2*d* are separated from one another by cutting lanes 20.

Figure 2:
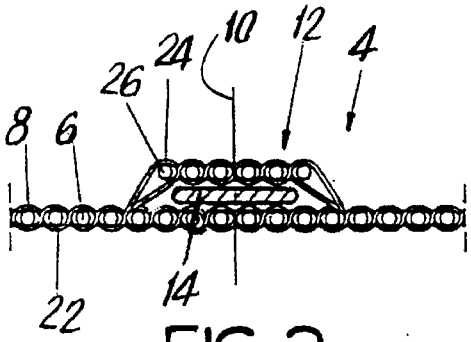
FIG. 2 a hollow fabric marker profile of a fabric run of FIG. 1, in cross-sectional view.
Figure 3:
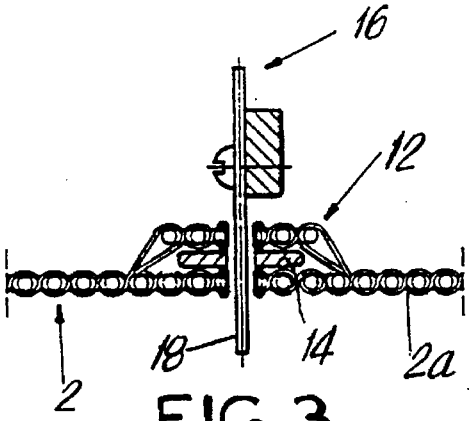
FIG. 3 cutting of the fabric run as per FIG. 2, in cross-sectional view.
Figure 4:
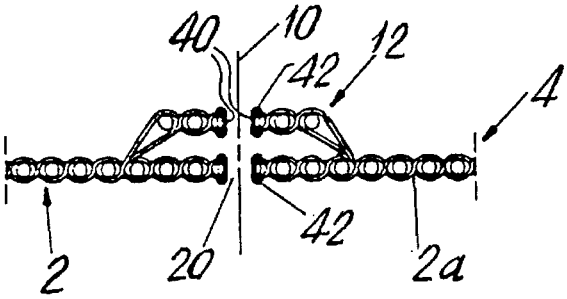
FIG. 4 the cut fabric run as per FIG. 2, in cross-sectional view.

The woven fabric run can be e.g. in the form of the one shown in FIG. 2, in which case warp threads 6 are held together by weft threads 8, thereby forming a ground fabric 22. The hollow fabric marker profile is formed by means of weft threads 24 and warp threads 26 extending on the back of ground fabric 22 in other words, a hollow fabric area is produced between the ground fabric 22 and an additional fabric formed by the weft threads 24 and the warp threads 26, wherein the edges of the additional fabric are connected by weaving to the ground fabric 22. As shown in FIGS. 2 and 3, and in particular 6 and 7, the hollow fabric marker profile 12 serves for guiding the sensing tongue 14 of the cutting head 28 of cutting device 16 such that the cutting tool 18 is aligned exactly with the cutting line 10 at all times. The cutting device 16 has a cutting head 28 for each cutting line 10, each of which carries a cutting tool 18 in the form of a heated cutting wire on the carrying arms 30, 32. The cutting head 28 is fastened via joint 34 to a support 36 which in turn is fasten ed to a bracket 38 overreaching the fabric run 4 or the ribbons 2. The cutting head can hence execute a movement perpendicular to the cutting lines. In addition, the cutting head 28 contains a sensing device formed by the sensing tongue 14 which is guided in the hollow fabric marker profile 12 such that the cutting head 28 or the cutting tool 18 can align itself with the course of the hollow fabric marker profile 12. On a directional change of the cutting line 10 or of the hollow fabric marker profile 12 allocated to the cutting line, due to the engagement of the sensing tongue 14 into the hollow fabric marker profile 12 the cutting head 28 follows the cutting line 10 with high accuracy. The cutting tool 18 cuts the fabric run 4 into individual ribbons 2, 2*a*, 2*b*, 2*c* with melting blades. On both sides of the resultant cutting lane 20 each ribbon has cut surfaces 40 of melted fabric material, and the melted mass 42 solidifies the cut ribbons 2, 2*a* against fraying.

Figure 5:
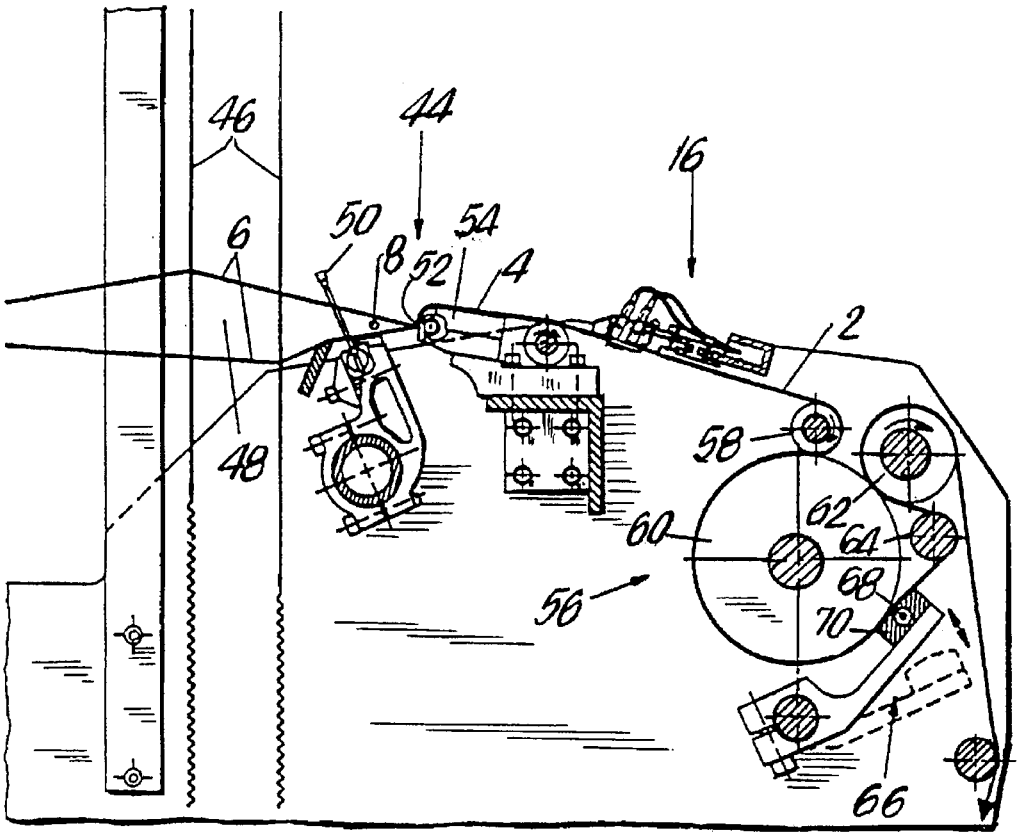
FIG. 5 an installation for the manufacture and cutting of a fabric run according to FIG. 1, in vertical cross-sectional view.

As shown in FIGS. 1 and 5, the cutting of the fabric run 4 takes place during the production of the woven fabric run. For this purpose the installation contains a weaving area 44 with warp threads 6 guided by heddles 46 which form an alternating shed 48 into which the weft thread 8 is inserted and beat up to a weaving edge 52 by a reed 50. The loom control is designed in a known manner in that the aforementioned hollow fabric marker profiles are produced in the fabric run along the defined cutting lines. A fabric hold-down device 54 serves to guide the woven fabric run 4 to the aforementioned cutting device by which the fabric run 4 is cut into the ribbons 2, which are then taken off by a fabric take-off device 56 and supplied to a fabric beam, not shown. The fabric take-off device 56 has a first deflector roll 58, a take-off roll 60, as well as further deflector rolls 62, 64. It is also equipped with a thermofixing device 66. The latter is equipped with a pad 70, which is heated by heater 68 and which presses against the cut ribbons 2.

Figure 6:
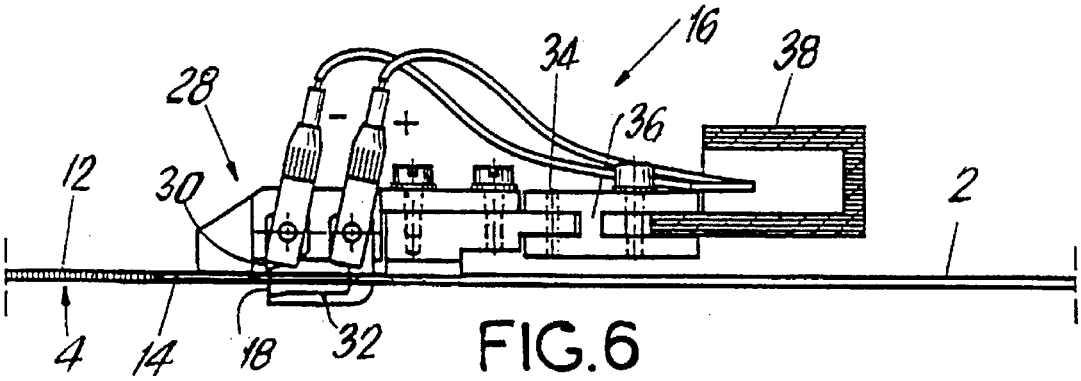
FIG. 6 the cutting device of the installation as per FIG. 5, side elevation and in enlarged scale.
Figure 7:
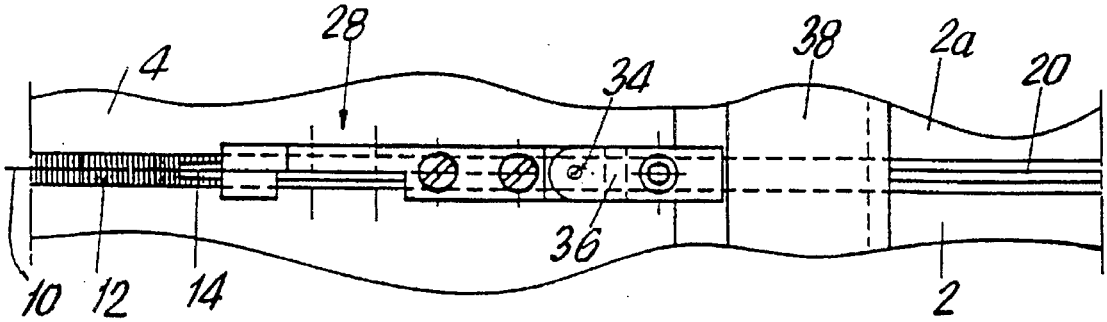
FIG. 7 the cutting device shown in FIG. 6, in plan view.
Figure 8:
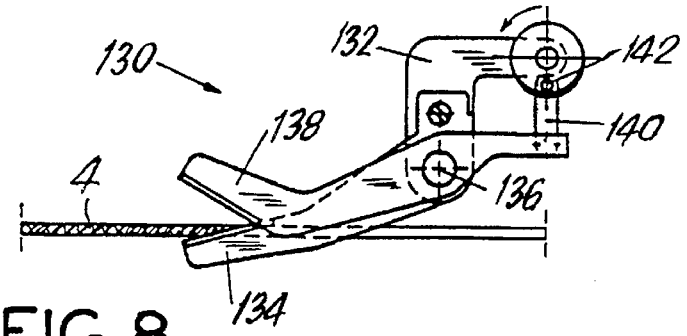
FIG. 8 a mechanical cutting device, side elevation.
Figure 9:
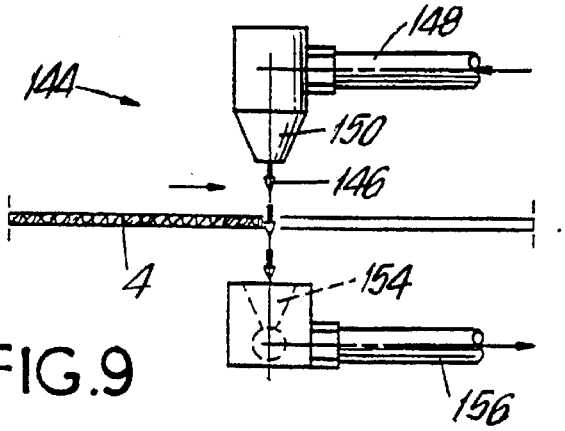
FIG. 9 a further thermal cutting device, side elevation.
Figure 10:
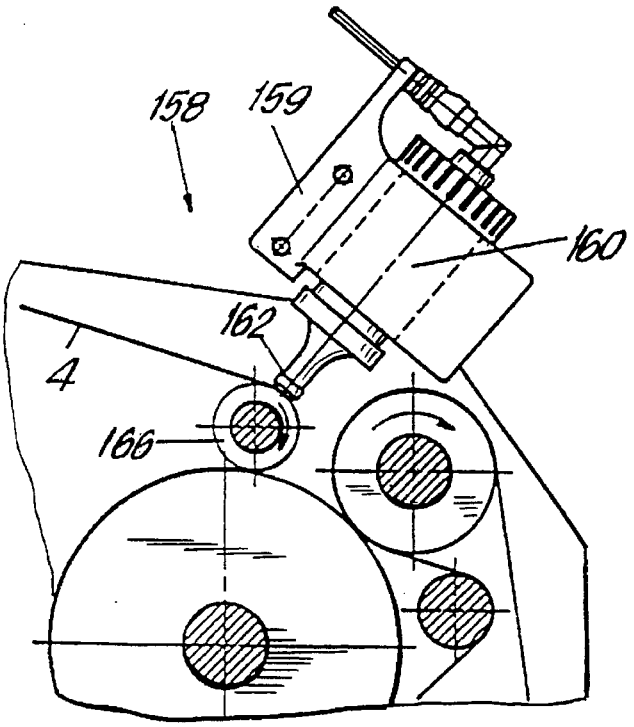
FIG. 10 a further cutting device with vibrator, side elevation.

The FIGS. 8, 9 and 10 show various cutting heads of further cutting devices which can be guided along a hollow fabric marker profile in a manner not illustrated analogous to the cutting device 16 of FIGS. 6 and 7. The cutting heads can be arranged in a pivotal or movable manner, also not shown, to a support overreaching the fabric run.

FIG. 8 shows the cutting head 130 of a mechanical cutting device with a stationary shear blade 134 affixed to a bracket 132. A pivotal shear blade 138 is mounted on a shaft 136 of the bracket 132, the drive of which is connected via a coupling link 140 to a driven cam 142 for the purpose of cutting the fabric run 4.

The cutting head 144 of a thermal cutting device of FIG. 9 works with a hot medium 146 which is supplied via a line 148 to a nozzle 150. This nozzle blows the hot medium 146 under high pressure through the fabric run 4 consisting of thermoplastic material, so that the latter melts. An intake funnel 154 serves to accept the hot medium flow and melted textile material, and is fitted with a corresponding discharge line 156.

Finally, FIG. 10 shows the cutting head 158 of a cutting device which is equipped with a vibrator 160 arranged on a bracket 159 above the fabric run 4 that generates vibrations in the ultrasonic range and transmits them via a cutting punch 162 to the fabric run 4 which runs over a deflector roll 166. As a result of the high vibration of 20–40 kHz the fabric run of thermoplastic material is heated up to the extent that it melts and is thereby cut.

I claim:

1. A process for cutting a fabric run, the fabric run being manufactured with at least one fabric marker profile having the shape of an elongated hollow space and extending along a predetermined cutting line, the process comprising guiding a sensing tongue of a sensing device in the hollow space of the fabric marker profile, guiding a cutting device by means of the sensing device, and cutting the fabric run along the predetermined cutting line by means of the cutting device.

2. The process according to claim 1, wherein the cutting device includes a cutting head, further comprising moving the cutting head by the sensing device transversely to the fabric run.

3. The process according to claim 1, wherein the cutting device includes a cutting head, further comprising pivoting the cutting head by the sensing device transversely to the fabric run.

4. The process according to claim 1, comprising carrying out cutting during the course of manufacturing the fabric run.

5. The process according to claim 1, comprising manufacturing the fabric run by knitting.

6. The process according to claim 1, comprising manufacturing the fabric run by weaving.

7. The process according to claim 1, wherein the fabric run is manufactured of thermal plastic material.

8. The process according to claim 1, comprising cutting the fabric run into narrow fabrics.

9. The process according to claim 8, comprising cutting the fabric run into patterned label ribbons.

* * * * *